United States Patent [19]

Bryant

[11] 4,326,602

[45] Apr. 27, 1982

[54] PORTABLE STABBING BOARD

[75] Inventor: Bill R. Bryant, Houston, Tex.

[73] Assignee: Houston Tong Services, Inc., Houston, Tex.

[21] Appl. No.: 1,295

[22] Filed: Jan. 5, 1979

[51] Int. Cl.[3] ..... E04G 3/10; E21B 19/00

[52] U.S. Cl. ..... 182/82; 182/142; 182/114; 175/85

[58] Field of Search ..... 182/82, 114, 142, 146, 182/145, 229, 206; 214/2.5; 414/22; 175/85

[56] References Cited

U.S. PATENT DOCUMENTS

| | | | |
|---|---|---|---|
| 71,791 | 12/1867 | Robinson | 182/146 |
| 889,494 | 6/1908 | Van Halder | 182/155 |
| 2,112,837 | 4/1938 | Fisher | 182/142 |
| 2,345,253 | 3/1944 | Funk | 182/114 |
| 2,531,930 | 11/1950 | Woolslayer | 414/42 |
| 2,570,076 | 10/1951 | Sims | 182/146 |
| 2,582,528 | 1/1952 | Cranford | 182/146 |
| 2,966,228 | 12/1960 | Kowalski | 182/206 |
| 3,501,027 | 3/1970 | Dea | 214/16 |
| 3,976,207 | 8/1976 | Schulz | 214/2.5 |
| 4,053,063 | 10/1977 | Harper | 214/2.5 |
| 4,071,115 | 1/1978 | Garcia | 187/2 |
| 4,157,129 | 6/1979 | Chris topher | 182/114 |

FOREIGN PATENT DOCUMENTS

| | | | |
|---|---|---|---|
| 540339 | 4/1922 | France | 182/146 |

OTHER PUBLICATIONS

RCA Technical Notes "Servicing Ladder", Kenneth C. Gasper, 6/11/1975.

*Primary Examiner*—Reinaldo P. Machado

*Attorney, Agent, or Firm*—Pravel, Gambrell, Hewitt, Kirk, Kimball & Dodge

[57] ABSTRACT

A portable stabbing board adapted to be attached to a rig for supporting a worker while stabbing joints of tubular members together during running operations including a frame member mountable with the rig, attachment members with the frame member for removably securing the frame member with the rig, a platform adapted for vertical movement along the frame member for supporting a worker during running operations, power means mounted with the platform for providing motive force for moving the platform vertically with respect to the frame member, and safety members with the platform and frame member for preventing unwanted vertical movement of the platform during such running operations.

10 Claims, 6 Drawing Figures

Fig. 1
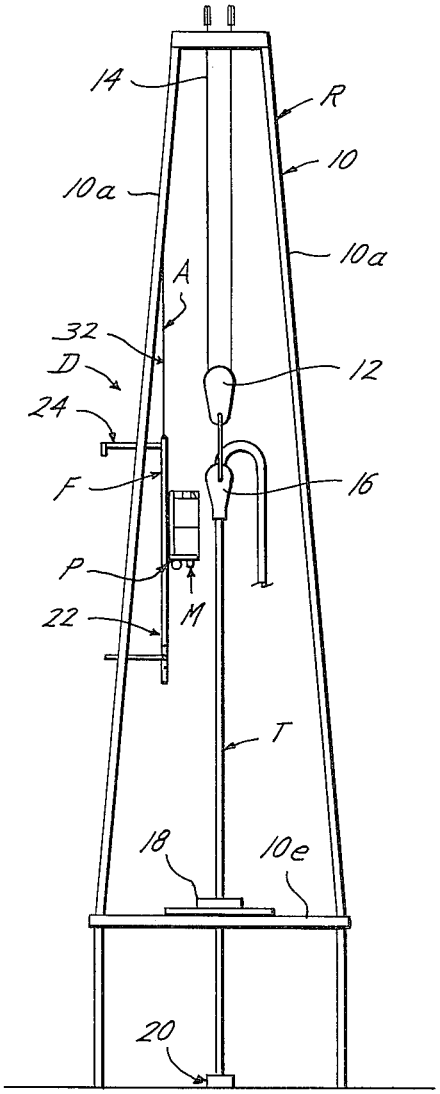
Fig. 4
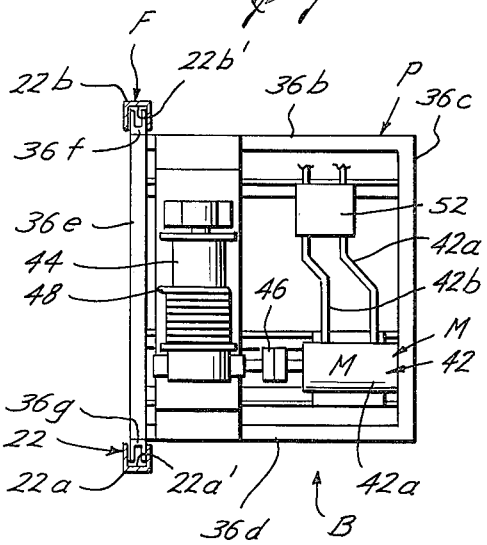
Fig. 5
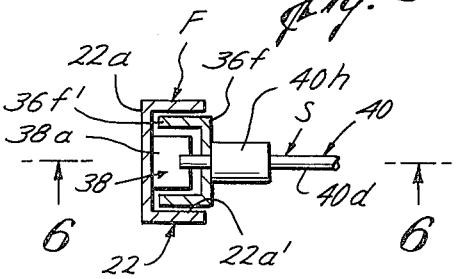
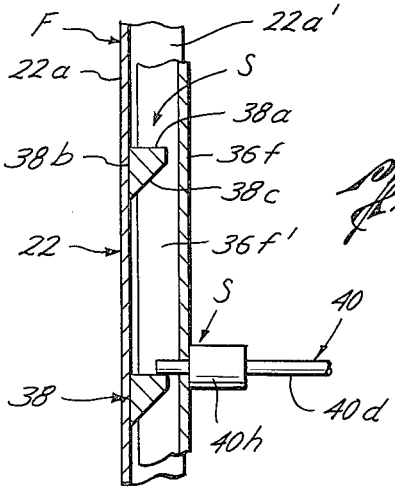
Fig. 6

A
32a
32
26
24
24a
A
30
10b
30a
24b
24c
24d
B
24a
F
22
48
22e
36n
R
10a
22f
36m
10
36h
36i
36k
10c
22g
36f
50
36a
P
36e
40k
22h
36b
42a
44
46
42
M
4
4
22i
A
34a
22l
34b
10d
34
34d
34c

A
32
32a
48a
32b
28
22c
22j
26
22
22m
48
22a
22b
F
22e
36k
36i
22f
36l
36j
36h
40
36f
36g
5
5
40
S
40c
40a
40h
40d
40i
40j
40b
40g
40f
50
42
M
48b
44
36c
22i
22l
22l
34b
34b
22d
22k

PORTABLE STABBING BOARD

TECHNICAL FIELD

The field of this invention is devices used and attached to a drilling rig for supporting a worker while stabbing joints of pipe or casing during running operations.

PRIOR ART

In the prior art, many types of devices have been used generally for pipe handling and operations attendant thereto. Some types of devices incorporate entire pipe handling systems and racking assemblies, such as disclosed in U.S. Pat. Nos. 4,053,063 and 3,501,027, which include motor vehicle combinations in conjunction with such pipe handling equipment. Such systems are costly and most complex.

Other types of systems include self contained mobile-vehicular lifting devices having adjustable work platforms such as that shown in U.S. Pat. No. 4,071,115, but typically are not used in the pipe handling-oilfield related operations. On the other hand, some devices, are adapted to be mounted with a rig during pipe handling operations, which include devices as shown in U.S. Pat. Nos. 2,531,930 and 3,976,207. U.S. Pat. No. 2,531,930 discloses a well drilling structure provided with a drill pipe hoist that incorporates a working platform that is pivotally mounted to a mast and is movable with movement of the mast. U.S. Pat. No. 3,976,207 discloses the use of a removable platform used for casing stabbing operations, wherein a casing handling head for grasping the casing pipe is integrally mounted with the platform. Massive support members must necessarily be erected as well as connections of operative fluid lines be made in order to make the casing stabbing apparatus of U.S. Pat. No. 3,976,207 operational.

So far as known, there is no prior art teaching of a truly portable stabbing board that may be quickly installed with the drilling rig requiring no significant ground based structural members, yet providing flexibility for a worker in the stabbing joints of tubular members during stabbing operations.

SUMMARY OF THE INVENTION

It is an object of this invention to provide a new and useful portable stabbing board for use by a worker during the stabbing of joints of pipe or casing together during running operations.

The portable stabbing board of the present invention includes a frame member, attachment members for attaching the frame with the drilling rig, a platform mounted for vertical movement along the frame member for supporting a worker during running operations, power means mounted beneath the platform for providing motive force for moving the platform vertically with respect to the frame member and safety members with the platform and the frame member for preventing unwanted vertical movement of the platform during such operations.

It should be understood that this description of the invention is not intended to be limiting but is only exemplary of the many patentable features of this invention, which are set forth in the claims.

BRIEF DESCRIPTION OF THE DRAWINGS

FIG. 1 is a side elevational view of the portable stabbing board of the present invention as shown affixed with a drilling rig adjacent to the vicinity where joints of tubular members are stabbed during running operations;

FIG. 4 is a sectional plan view of the platform of the portable stabbing board of the present invention as taken along the lines 4—4 of FIG. 2;

FIG. 5 is a sectional plan view of a portion of the safety means of the portable stabbing board of the present invention as taken along the lines 5—5 of FIG. 3; and, FIG. 6 is a sectional elevational view of a portion of the safety means of the portable stabbing board of the present invention as taken along the lines 6—6 of FIG. 5.

DESCRIPTION OF THE PREFERRED EMBODIMENT

Figure 2:
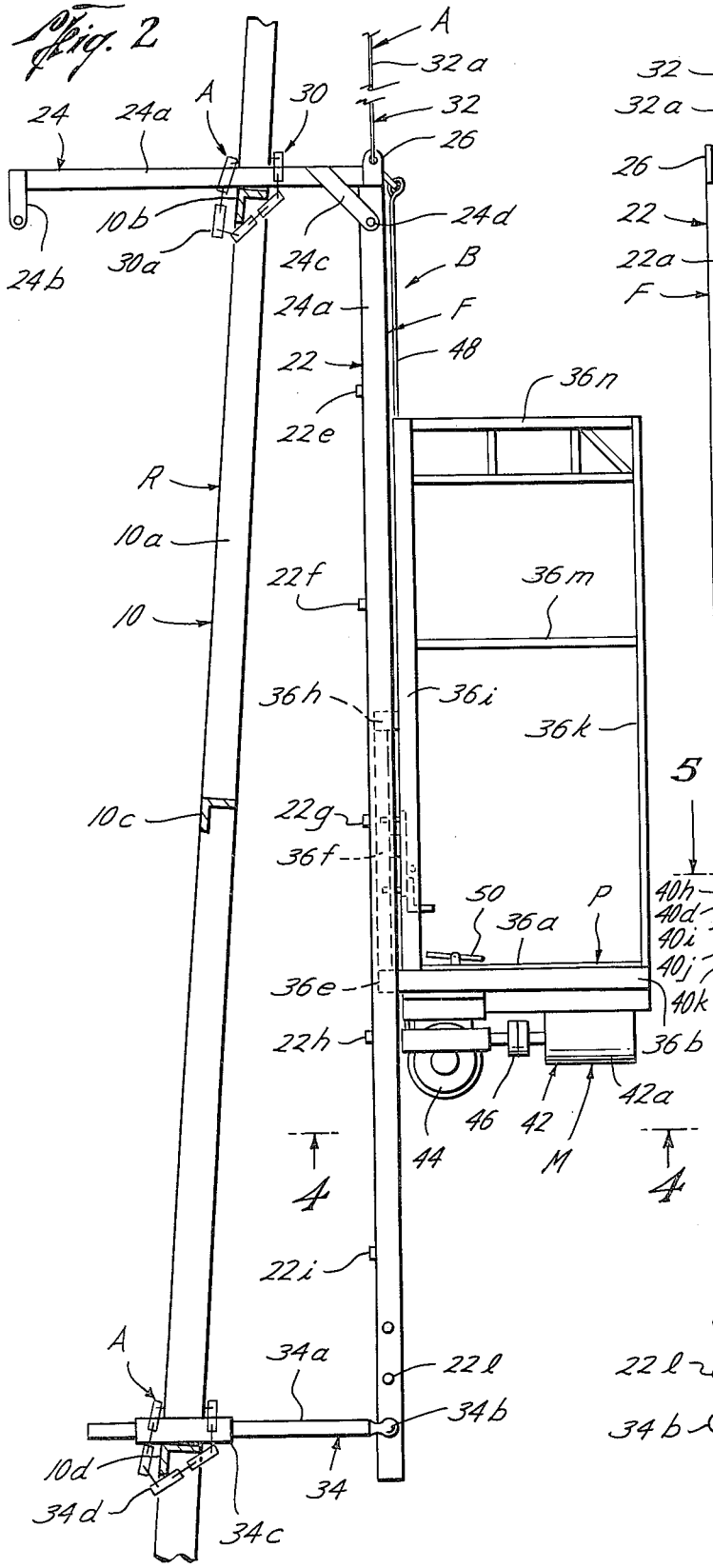
FIG. 2 is an enlarged side elevational view of the portable stabbing board of FIG. 1 of the present invention as mounted with a drilling rig.

Referring to the drawings, the letter B designates generally the portable stabbing board B of the present invention. The portable stabbing board B is adapted to be attached to a rig R for supporting a worker in stabbing joints of tubular members T together during running operations. The portable stabbing board B includes generally a frame member F, attachment means A, a platform P, power means M and safety means S. Unless otherwise specified, it is preferred that the components of the invention be made of steel or other suitable high-strength materials capable of taking stresses and strains encumbent upon such a portable stabbing board B during its intended use during stabbing operations.

The portable stabbing board B is adapted to be attached to a rig R such as drilling rig 10. As is well known and preferred, the drilling rig 10 has rig sides 10*a* generally formed of a plurality of braces such as braces 10*b*, 10*c*, 10*d* (FIG. 2) that make up and form a part of the drilling rig 10. The drilling rig 10 further includes rig platform 10*e*. Associated rig hardware typically used in running operations is shown schematically in FIG. 1 and includes an appropriate block 12, supported by appropriate cables 14, with the block 12 supporting a suitable elevator 16 used for raising and lowering tubular members T. The tubular members T may include pipe, casing, or any other types of suitable tubular members used in typical rig R operations. As is known, the elevator 16 supports the tubular members T as they are individually inserted through the rotary table 18 mounted with the rig platform 10*e*, whereinafter the tubular members T are individually fed into the well designated generally as 20 that is being serviced by the drilling rig 10.

The portable stabbing board B of the present invention includes a frame member F adapted to be affixed with the rig R in a vertical plane substantially parallel with the tubular members T. The frame member F includes frame member 22 which includes a pair of vertical, substantially parallel channel members 22*a*, 22*b*. The channel members 22*a*, 22*b* preferably are of a U-shaped channel having channel troughs 22*a*', 22*b*' formed within the U-shaped channel members with the channel troughs 22*a*', 22*b*' of the channel members 22*a*, 22*b* facing inwardly with respect to the frame member 22. Top frame member 22*c* and bottom frame member 22*d* separate and maintain the substantially parallel vertical relationship of the channel members 22*a*, 22*b* and provide for the upper and lower strength of the frame member F of the present invention. Braces 22*e*, 22*f*, 22*g*, 22*h*, 22*i* provide further structural support for the frame member F and are mounted therewith adjacent the exterior surface of the vertical channel members 22*a*, 22*b* and preferably not within the troughs 22*a*', 22*b*' of the channel members 22*a*, 22*b* as discussed more fully hereinbelow. The upper end 22*j* of the frame member 22 is formed by the top frame member 22*c* and the adjacent portions of channel members 22*a*, 22*b* while the lower end 22*k* of the frame member 22 is formed by bottom frame member 22*d* and adjacent channel member 22*a*, 22*b*, respectively. It is preferred that the frame member F be of a rigid construction, as noted hereinabove; however, a foldable or collapsible construction may be used if desired.

The portable stabbing board B of the present invention further includes attachment means A with the frame member F for removably securing the frame member F with the rig R. The attachment means A includes a top support member 24 (FIG. 2) mounted with the upper end 22*j* of the frame member 22. The top support member 24 includes a pair of top supports 24*a* (only one shown in the drawings), each substantially alike and having a suitable hook 24*b* formed adjacent one end thereof. The other end of the top support member 24 includes bracket 24*c* secured with top support 24*a* and adapted to be pivotally mounted with the frame member F by means of pivot pin 24*d*.

The top support member 24 is movable from a collapsed, first position (not shown) wherein the top support member 24 is substantially parallel and adjacent to the frame member F to a second position (FIG. 2) wherein the top support member 24 is substantially perpendicular to the frame member F adjacent to the upper end 22*j* of the frame member F. The top support member 24 is adapted to supportably engage the rig R for supporting the frame member F when the top support member 24 is in the second position. When in the second position, the top support 24*a* engages and abuts tabs 26, 28 mounted with the frame member 22 adjacent top frame member 22*c* adjacent the upper end 22*j* thereof, for limiting movement of the top support member 24 to that of a substantially perpendicular relationship with the frame member F. The top support member 24 is mounted with the rig R in such a fashion that the top support 24*a* may extend through the rig side 10*a* with a portion thereof disposed on brace 10*b* of the drilling rig 10 when the top support member 24 is in the second position. A suitable fastener 30 such as chain 30*a* or any other suitable means is used to affix the top support 24*a* with the brace 10*b* of the drilling rig 10, for ease in quick mounting procedures therewith.

The attachment means A further includes hanging means designated generally as 32 for vertically locating the frame member F within the rig R. The hanging means 32 preferably includes cables 32*a*, 32*b* affixed to the tabs 26, 28, respectively, for extending between and attaching the upper end 22*j* of the frame member 22 with the drilling rig 10 along the vertical plane of the frame member 22, as best shown in FIG. 1.

Figure 3:
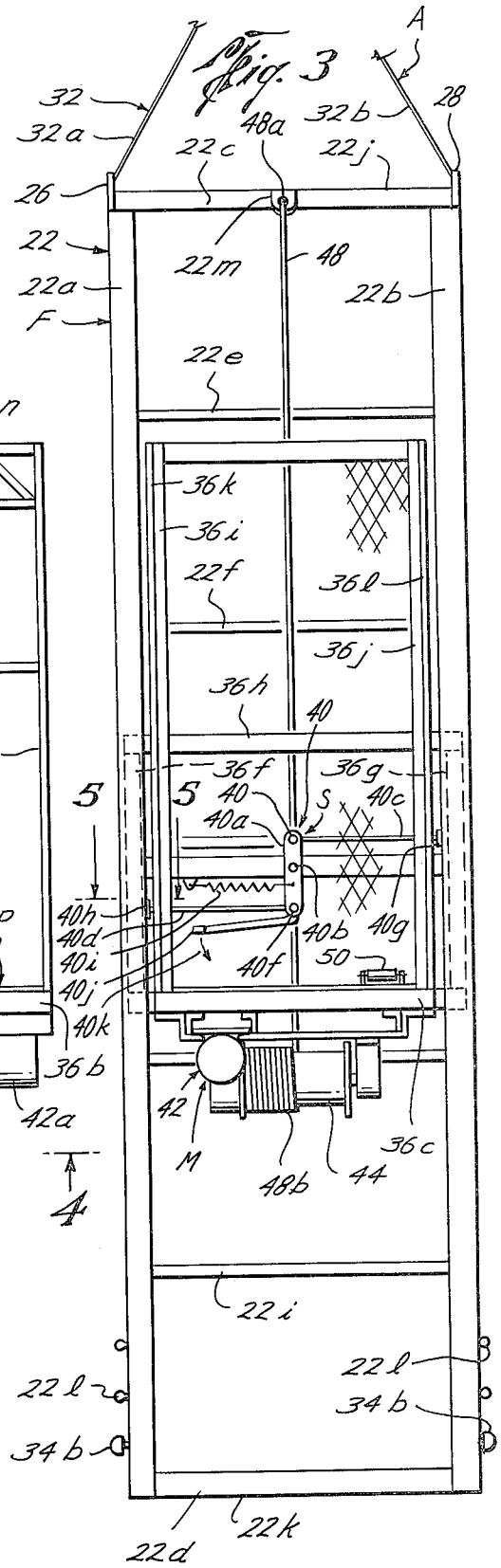
FIG. 3 is a front elevational view of the portable stabbing board of FIG. 2.

The attachment means A of the portable stabbing board B of the present invention further includes bottom locating means designated generally as 34. The bottom locating means 34 includes at least one arm 34*a* adapted to be mounted with the lower end 22*k* of the frame member 22. Multiple arms 34*a* may be used, if desired. The arm 24*a* preferably is formed having a socket 34*b* formed adjacent the end thereof for receiving a suitable ball such as ball 22*l* mounted with the frame member 22 adjacent the lower end 22*k* thereof. As shown in FIG. 3, multiple balls 22*l* may be mounted with and along the vertical channel members 22*a*, 22*b* adjacent the lower end 22*k* thereof and that more than one arm 34*a* may be mounted therewith. It is preferred that an arm 34*a* be mounted with each respective channel member 22*a*, 22*b* adjacent the lower end thereof and that the arm 34*a* be of a circular cross section; however, any suitable configuration may be used as is desired. The ball 22*l* and socket 34*b* arrangement of the bottom locating means 34 results in substantially universal mounting of the arm 34*a* with the frame member 22 such that the arm 34*a* may pivot about the ball 22*l* in a vertical plane as well as have limited lateral movement with respect to the frame member 22.

The bottom locating means 34 further includes a sleeve 34*c* slidably mounted with arm 34*a* and movable along the length thereof as desired. Appropriate securing means 34*d* which may include an appropriate chain or the like affixed with the sleeve 34*c*. As such, the bottom locating means 34 is for locating the lower end 22*k* of the frame member 22 an appropriate distance from the rig R to insure a substantially vertical disposition of the frame member 22 within the rig R. The arm 34*a* extends from the frame member 22 through the rig side 10*a* of the drilling rig 10 for engaging brace 10*d* thereof. More particularly, the sleeve 34*c* is positioned with the arm 34*a* such that the sleeve engages the brace 10*d* of the rig 10 and the securing means 34*d* secures the sleeve 34*c* and consequently arm 34*a* to the drilling rig 10 upon being suitably disposed thereabout the brace 10*d*, for ease in quick mounting.

The portable stabbing board B of the present invention further includes a platform P mounted for vertical movement along the frame member F for supporting the worker during running operations. The platform P includes platform 36 having a floor 36*a* supported by platform supports 36*b*, 36*c*, 36*d* (FIG. 4) affixed to rear platform support 36*e*. Rear platform support 36*e* has platform channel supports 36*f*, 36*g* mounted therewith and extend upwardly from floor 36*a*, having top rear support 36*h* mounted therewith. Vertical cage members 36*i*, 36*j*, 36*k*, 36*l* mounted with platform supports 36*b*, 36*c*, 36*d* and rear platform support 36*e* extend upwardly therefrom and form the perimeter of a working cage for the worker utilizing the portable stabbing board B of the present invention. The vertical cage members 36*i*, 36*j*, 36*k*, 36*l* have appropriate braces such as brace 36*m* and top latticework 36*n* therewith for providing suitable structural support for the vertical cage members with platform 36 of the present invention. Wire screen 36*w* with the vertical cage members prevents inadvertent slipping of the worker or loss of tools thereof from back of platform P when in use. It is preferred that the rear platform support 36*e*, platform channel supports 36*f*, 36*g* and top rear support 36*h* are sized such that they may be disposed within the channel troughs 22*a*', 22*b*' formed within vertical channel members 22*a*, 22*b* of the frame member 22. Preferably, the platform channel supports 36*f*, 36*g* are of a U-shaped channel configuration having a suitable trough 36*g*' formed therein with the platform channel supports 36*f*, 36*g* adapted to be received within the channel troughs 22*a*', 22*b*' of the vertical channel members 22*a*, 22*b* of the frame member 22. It is preferred that the platform troughs 36f, 36g' of the platform channel supports 36f, 36g extend outwardly with respect to the platform 36 and are mountable within the troughs 22a', 22b' of the channel members 22a, 22b.

The portable stabbing board B of the present invention further includes safety means S with the platform P and frame member F for preventing unwanted vertical movement of the platform P during running operations. The safety means S includes a plurality of pawls 38 mounted with and along the length of the channel troughs 22a', 22b' of the channel members 22a, 22b at selected positions. The pawls 38 as best seen in FIGS. 5 and 6 are preferably formed having an upper surface 38a, vertical surface 38b, lower inclined surface 38c and vertical surface 38d. It is preferred that the vertical surface 38b be attached to the channel members 22a, 22b within the respective troughs 22a', 22b' thereof and centered substantially therein. Centering of the pawls 38 within the troughs 22a', 22b' allows the platform channel supports 36f, 36g to move vertically within the troughs 22a', 22b' without engaging or interfering with the pawls 38. It will be appreciated that a number of pawls 38 may be disposed along the entire lengths of the vertical channel members 22a, 22b in troughs 22a', 22b', if desired.

The safety means S of the present invention further includes a safety mechanism designated generally as 40 mounted with the platform P for selectively engaging the pawls 38 as desired to prevent unwanted vertical movement of the platform P during running operations. The safety mechanism 40 includes an actuating arm 40a pivotally mounted with the platform P by means of pivot pin 40b. Safety arms 40c, 40d are pivotally affixed to the actuating arm 40a by means of pivot pins 40e, 40f, respectively. Bushings 40g, 40h are mounted with the platform channel supports 36g, 36f, respectively, for slidably receiving the safety arms 40c, 40d therein, respectively. As best seen in FIGS. 5 and 6, the safety arm such as safety arm 40d extends through bushing 40h mounted with platform chanel support 36f for engaging the upper surface 38a of pawl 38. Similarly, safety arm 40c engages a suitable pawl 38 (not shown) mounted with the vertical channel member 22b. The engagement of the safety arms 40c, 40d with the upper surface 38a of a pawl 38 prevents the platform P from moving vertically with respect to the frame member F. A safety spring 40i is mounted with the actuating arm 40a and the platform P to insure tensioning on the safety mechanism 40 such that the safety arms 40c, 40d are biased in an engaging position with the upper surface 38a of pawls 38. A foot lever 40j is affixed to the actuating arm 40a for foot operated movement by the worker for releasing the safety arms 40c, 40d from the engaging position to a releasing position wherein the safety arms 40c, 40d do not engage the upper surface 38a of the pawl and are retracted inwardly such that the ends of the safety arms 40c, 40d do not engage the vertical surface 38d of pawls 38. Movement from the engaging position to the releasing position is effectuated by movement of the lever 40j in the direction of arrow 40k (FIG. 3).

It will be appreciated that vertical upward movement of the platform P of the present invention is permitted even with the safety mechanism 40 in the engaged position. During such upward vertical movement of the platform P with respect to the frame member F, the safety arms 40c, 40d contact the lower, inclined surface 38c of the pawl 38 above the pawl 38 that the safety arms 40c, 40d had previously engaged. Upon the safety arms 40c, 40d engaging such lower, inclined surface 38c, the incline thereof forces the safety mechanism 40 to a non-engaging position against the action of the safety spring 40i, along vertical surface 38d whereupon reaching the upper surface 38a of the pawl 38 above the original pawl 38, the safety arms 40c, 40d will thereafter engage the upper surface 38a thereof to prevent unwanted lowering of the platform P. However, if it is desired that the platform P be lowered, the worker need merely engage the foot lever 40j and push downwardly thereon in the direction of arrow 40k to release the safety arms 40c, 40d engagement with the pawls 38 to allow lowering of the platform P with respect to the frame member F.

The portable stabbing board B of the present invention further includes power means M mounted beneath the platform P for providing motive force for moving the platform P vertically with respect to the frame member F. The power means M includes a motor 42 which is preferably an air motor 42a or may alternatively be an electric or any other suitable type of motor mounted beneath the floor 36a of the platform 36. A winch drum 34 is also mounted beneath the floor 36a of platform 36 and in operative engagement with the air motor 42a by means of suitable power take-off 46. A cable 48 operably engages the winch drum 44 and is affixed to the upper end 22j of frame member 22 at tab 22m adjacent end 48a of cable 48. Cable portions 48b are adapted to be spooled about the winch drum 44 for operable engagement therebetween. The platform P is movable vertically along the frame member F upon actuation of the air motor 42a which results in reeling of the cable 48 with respect to the winch drum 44. Preferably, a pedal 50 is mounted with the floor 36a of platform 36 for foot operation thereof by the worker for actuating the air motor 42a. More specifically, the pedal 50 is operably connected to an appropriate valve 52 for regulating air flow thereto air motor 42a through air motor lines 42b, 42c. By placing the pedal 50 in one position, the air motor 42a is pneumatically powered to result in reeling of the cable 48 thereonto winch drum 44 resulting in upper, vertical movement of the platform P with respect to the frame member F. Alternatively, movement of the pedal 50 to a second, released position results in pneumatic pressure within the air motor 42a being released allowing the platform P to move downwardly with respect to the frame member F, subject only to releasing of the safety mechanism 40. Any inadvertent pedal movement to the release position results in the platform P not moving because of the safety arms 40c, 40d engaging pawls 38.

Thus, the portable stabbing board B of the present invention is adapted to be quickly mounted with a rig R for use in running operation which is significant in view of the tremendous per hour costs associated with such rigs R. It is preferred that the top support member be in the second position during preliminary installation procedures such that it rests upon brace 10b while the hanging means 32 is affixed to a brace substantially higher up than brace 10b on the rig side 10a of drilling rig 10 and that such be substantially in vertical alignment with the intended position of the frame member F with respect to the operations to be performed. The hook 24b is useful for engaging the brace 10b of drilling rig 10 during installation procedures to prevent the portable stabbing board B of the present invention from falling from the drilling rig 10 during such preliminary placement procedures. The cables 32*a*, 32*b* are appropriately affixed to such brace of the drilling rig 10. Thereafter, the fasteners 30, such as chain 30*a*, is affixed about the top support member 24 for securing the same with brace 10*b* of the drilling rig 10. The bottom locating means 34, including arms 34*a*, are thereafter spread out and positioned on appropriate braces such as brace 10*d* with the sleeves 34*c* positioned thereon the brace 10*d* and the securing means 34*d* thereafter being affixed in such a fashion to secure the bottom locating means 34 with the drilling rig 10. Relative positioning of the bottom locating means 34 with respect to the rig sides 10*a* results in substantially vertical disposition of the frame member F within the drilling rig 10. As such, running operations may immediately thereafter commence.

The worker preferably stands on the floor 36*a* of platform 36 for stabbing the appropriate tubular members T during such running operations. Should it be necessary that the platform P be raised, the worker need merely step on the pedal 50 resulting in actuation of the air motor 42*a* resulting in take-up of the cable 48*a* on winch drum 44 resulting in upward vertical movement of the platform P. The inclined surfaces 38*c* and vertical surfaces 38*d* of pawls 28 do not interfere with the upward movement inasmuch as the safety arms 40*c*, 40*d* are pushed out of engagement with the pawls 38 by means of the inclined surfaces 38*c*. After stopping at any suitable position, work may be commenced.

Should there be any failure of the air motor 42*a*-winch drum 44 system, any vertical downward movement of the platform P will be limited by the pawls 38 engagement with the safety mechanism 40. When it is desired that the platform P be lowered, the worker need only engage the pedal 50 to release pneumatic pressure in the air motor 42*a* while simultaneously engaging the foot lever 40*j* of safety mechanism 40 to release the engagement of the safety arms 40*c*, 40*d* with the pawls 38. Thus, the worker utilizing the portable stabbing board B of the present invention may move vertically with respect to the drilling rig 10 and frame member F to accomplish the stabbing of joints of tubular member T during running operations.

As will be appreciated, because of the ease of installation of the portable stabbing board B of the present invention, the portable stabbing board B may be moved throughout the drilling rig 10 with the minimum of time and effort necessary for moving same. Prior art stabbing boards involve installation procedures of several hours in duration whereas the portable stabbing board B of the present invention may be easily placed in position within such a drilling rig 10 within 20–30 minutes time, resulting in considerable savings in time, effort and expense.

Furthermore, the portable stabbing board B of the present invention may be compactly folded for transportation purposes in that the top support member 24 is pivotally mounted with the frame member 22 such that it is movable to the first position wherein the top support member 24 is substantially parallel and adjacent to the frame member 22 whereas the bottom locating means 34 is universally mounted such that the arm 34*a* may similarly move along side the channel members 22*a*, 22*b* of the frame member 22 for compact handling of the frame member F of the present invention. Thus, the present invention comprehends a portable stabbing board B that is a new and useful concept not heretofore known.

The foregoing disclosure and description of the invention are illustrative and explanatory thereof, and various changes in the size, shape and materials as well as in the details of the illustrated construction may be made without departing from the spirit of the invention.

I claim:

1. A portable stabbing board adapted to be attached to a rig having rig sides formed of a plurality of braces, the portable stabbing board for supporting a worker while stabbing joints of tubular members together during running operations, comprising:

a frame member adapted to be affixed with the rig in a vertical plane substantially parallel with the tubular members, said frame member having an upper end and a lower end;

attachment means with said frame member for removably securing said frame member with the rig, said attachment means including bottom locating means affixed with said lower end of said frame member for universally locating said lower end of said frame member an appropriate distance from the rig to insure substantial vertical disposition of said frame member within the rig, said bottom locating means including at least one arm vertically adjustable and universally mounted with said frame member and extending from said frame member through the rig side of the rig for engaging a brace thereof;

a platform mounted for vertical movement along said frame member for supporting the worker during running operations;

power means mounted with said platform for providing motive force for moving said platform vertically with respect to said frame member; and, safety means with said platform and said frame member for preventing unwanted vertical movement of said platform during running operations.

2. The portable stabbing board of claim 1, wherein:

said attachment means includes a top support member pivotally mounted with said upper end of said frame member, said top support member movable from a first position wherein said top support member is substantially parallel and adjacent to said frame member to a second position wherein said top support member is substantially perpendicular to said frame member adjacent said upper end of said frame member, said top support member adapted to supportably engage the rig for supporting said frame member when in said second position.

3. The portable stabbing board of claim 2, wherein the rig has rig sides formed of a plurality of braces, wherein:

said top support member is adapted to extend through the rig side with a portion thereof disposed on a brace of the rig when in said second position.

4. The portable stabbing board of claim 1, wherein:

said attachment means includes hanging means for vertically locating said frame member within the rig and for attaching said upper end of said frame member with the rig along the vertical plane of said frame member.

5. The portable stabbing board of claim 1, wherein said bottom locating means includes:

a sleeve slidably mounted with said arm and movable along the length thereof for engaging the brace of the rig; and, securing means attached to said sleeve for engaging and securing said sleeve to the rig.

6. The portable stabbing board of claim 1, wherein:

said frame member is formed of channel members having channel troughs, with said channel troughs of said channel members facing inwardly with respect to said frame member; and, said platform having platform channel support members having platform troughs adapted to be received within said channel members, said platform troughs of said channel support members extending outwardly with respect to said platform.

7. The portable stabbing board of claim 6, wherein said safety means includes:

a plurality of pawls mounted within and along the length of said channel troughs of said channel member at selected positions; and, a safety mechanism mounted with said platform for selectively engaging said pawls as desired to prevent unwanted vertical movement of said platform during running operations.

8. The portable stabbing board of claim 7, wherein said safety mechanism includes:

an actuating arm pivotally mounted with said platform;

at least one safety arm pivotally affixed to said actuating arm and adapted to engage said pawl when in an engaging position to prevent unwanted vertical movement of said platform;

a safety spring mounted with said actuating arm and said platform to insure maintenance of said safety arm in said engaging position; and, a foot lever affixed to said actuating arm for foot operated movement by the worker for releasing said safety arm from said engaging position to a releasing position wherein said safety arm does not engage said pawl.

9. The portable stabbing board of claim 1, further including:

a pedal mounted with said platform for foot operation thereof by the worker for actuating said air motor.

10. The portable stabbing board of claim 1, wherein said power means includes:

an air motor mounted beneath said platform;

a winch drum in operative engagement with said air motor and mounted beneath said platform;

a cable operably engaging said winch drum and affixed to said upper end of said frame member; and, said platform being movable vertically along said frame member upon actuation of said air motor which results in reeling of said cable with respect to said winch drum.

* * * * *